US005540125A

United States Patent [19]

Haskell

[11] Patent Number: 5,540,125

[45] Date of Patent: Jul. 30, 1996

[54] MULTI-POSITION LOCKING ADJUSTABLE WRENCH

[76] Inventor: Arthur Haskell, P.O. Box 452, Millinocket, Me. 04430

[21] Appl. No.: 391,584

[22] Filed: Feb. 21, 1995

Related U.S. Application Data

[63] Continuation-in-part of Ser. No. 191,638, Feb. 4, 1994, abandoned.

[51] Int. Cl.[6] ..... B25B 13/16

[52] U.S. Cl. ..... 81/170; 81/DIG. 3

[58] Field of Search ..... 81/165, 170, DIG. 3

[56] References Cited

U.S. PATENT DOCUMENTS

| | | | |
|---|---|---|---|
| 1,498,656 | 6/1924 | Herby | 81/DIG. 3 X |
| 2,316,455 | 4/1943 | Richardson | 81/165 |
| 2,849,908 | 9/1958 | Swanstrom et al. | 81/165 |
| 3,857,308 | 12/1974 | Lindgren | 81/157 |

*Primary Examiner*—James G. Smith
*Attorney, Agent, or Firm*—William B. Ritchie

[57] ABSTRACT

An adjustable wrench having selectable lockable positions. Selectable locking positions are obtained using a pair of locking ball bearings that engage a plurality of recesses located on both ends of the thumb wheel. The recesses on the end are offset to the recesses on the other end. The width of the recesses on one end is greater than the width of the recesses on the other end. The wrench retains its "locked" position even when jarred, yet can be easily moved to a new set position by rotating the thumb wheel to the next selectable notch.

12 Claims, 7 Drawing Sheets

MULTI-POSITION LOCKING ADJUSTABLE WRENCH

This application is a continuation-in-part of U.S. patent application Ser. No. 08/191,638, filed Feb. 4, 1994, now abandoned.

BACKGROUND OF THE INVENTION

1. Field of the Invention

The invention relates to an adjustable wrench which permits its sliding jaw to lock into different positions according to various nut or bolt sizes.

2. Description of the Related Art

Numerous situations exist in which it is advantageous to have an adjustable wrench that is capable of locking its sliding jaw. The most common situations occur in the maintenance field in which a mechanic needs to twist or turn nuts or bolts of varying sizes without having to readjust the setting of the wrench. Use of an adjustable wrench with a sliding jaw which is locked into position by nuts or bolts of different sizes avoids the problems that may be caused when attempting to conduct maintenance on large or elaborate machines with bolts or nuts which are not directly or easily accessible.

Various locking mechanisms have been devised for adjustable wrenches. U.S. Pat. No. 2,905,037, issued to Coslow on Sep. 22, 1959, discloses a worm locking means for an adjustable jaw wrench. The mechanism works on the principle that the more force placed on the jaws, the more securely the jaws lock into place. The jaw is "locked" by means of moveable V-shaped teeth in the worm that are urged against fixed V-shaped teeth in the frame. The teeth in the wrench have a high wear potential and will quickly lose their ability to "click" in adjustment. Further, if the wrench is jarred, the position of the jaws can easily change since the teeth will jump into a new position.

U.S. Pat. No. 5,154,103, issued to Lewis on Oct. 13, 1992, describes a lock for an adjustable wrench employing an elongated slide and a worm wheel with inner and outer surfaces which frictionally prevent the movement of the sliding jaw, thus locking the jaw into place.

U.S. Pat. No. 4,106,372, issued to Miller on Apr. 12, 1977, discloses an adjustable end wrench with a fixed jaw, a movable jaw and a locking means. The locking means is provided by a latch with a protrusion which selectively engages a groove on the movable jaw which prevents the jaw from moving any further. The lock provided on the movable jaw results from the mating of the teeth of the movable jaw with those on the latch. This approach also relies on the use of friction between the teeth on the latch and the teeth on the movable jaw to selectively lock the jaw into the desired position.

U.S. Pat. No. 4,454,791, issued to Seward, discloses a lockable adjustable wrench with a lock member that simultaneously engages a rack gear and a rotatable gear on the wrench. This approach relies on the frictional locking action that occurs when the teeth on the lock member, the rack gear and the rotatable gear are meshed together to prevent the sliding jaw from moving any further.

U.S. Pat. No. 4,326,436, issued to McGraw on Apr. 27, 1982, describes a combination adjustable/lockable/measuring wrench having a fixed jaw, a sliding jaw and preset means for locking and unlocking the location of the sliding jaw. The locking means used requires a brake which is selectively actuated by the use of a translatable push button to cause a tightening of a rotatable shaft and worm. The button rod engaged by the translatable push button increases the frictional tightness on the rotatable shaft. This approach relies on the use of friction between mechanical elements to prevent further movement of the sliding jaw.

U.S. Pat. No. 2,849,908, issued to Swanstrom et al. on Sep. 2, 1958, discloses an adjustable wrench that utilizes a specialized thumb wheel and a plate member with ears that attempts to lock the thumb wheel into position via a mushroom shaped pin. This design requires additional parts that must be carefully machined to exact tolerances thus substantially increasing the cost of manufacture. Also, to change the size of the wrench, the operator must release the plate member by compressing a spring while simultaneously turning the thumb wheel.

U.S. Pat. No. 1,498,656, issued to Herby on Jun. 24, 1924, discloses another adjustable wrench that attempts to retain the adjustment of the jaws. The thumb wheel is fitted with radiating grooves on the end facing the fixed jaw of the wrench. A pin in a pocket that is urged against a spring causes the pin to engage the grooves on the thumb wheel. The use of the pin causes wear to occur on the grooves which result in a loss of control after a period of time. Also, the use of only one side of the thumb wheel limits the number of fixed positions that can be obtained.

U.S. Pat. No. 3,857,308, issued to Lindgren on Dec. 31, 1974, discloses still another adjustable wrench. This disclosure attempts to solve the problem of the thumb wheel wearing against the mounting and the need for two different sized holes to mount the thumb wheel. In this disclosure, the thumb wheel is mounted via two ball bearings at opposing ends urged against the wrench frame via a single spring. A single hole drilled through the wrench frame serves to position the thumb wheel via the two balls engaging the bore of the hole.

A multi-position adjustable wrench that provides a constant locking force, having low wear characteristics, having sufficient adjustment capability to meet most standard sized nuts and points in between simply by rotating the thumb wheel is not found in the prior art.

SUMMARY OF THE INVENTION

It is an object of the invention to provide a multi-position lockable adjustable wrench that selectively locks the sliding jaw of the wrench in different fixed positions with the use of ball bearings.

It is another object of the invention to provide a multi-position lockable adjustable wrench that permits exact manual control over the spacing between the sliding jaw and the fixed jaw.

Yet another object of the invention is to provide a multi-position lockable adjustable wrench that has locking features having low wear potential.

Still another object of the invention is to provide a multi-position lockable adjustable wrench that has a locking mechanism that is floating so that the wrench cannot "jump" a setting when it is jarred.

It is another object of the invention to provide a multi-position lockable adjustable wrench that positions the adjustable thumb screw within the wrench without the need for elaborate positioning frames or other such structures.

Another object of the invention is to provide a multi-position lockable adjustable wrench that eliminates the counter sunk hole on the thumb wheel and eliminates the spring found on standard adjustable wrenches.

It is another object of the invention to provide a multi-position lockable adjustable wrench that outwardly appears the same as standard adjustable wrenches lacking a multi-position lockable feature.

Another object of the invention is to provide a multi-position lockable adjustable wrench that can be produced using standard manufacturing techniques employed to make non-locking adjustable wrenches.

It is a final object of the invention to provide a multi-position lockable adjustable wrench that can be "locked" into various sizes that fit the most common nut dimensions within the adjustable range of the particular wrench size selected.

The invention is an adjustable jaw wrench with selectable lockable positions. A handle including a fixed jaw is provided. A moveable jaw including a rack with a plurality of teeth supported on said handle for movement toward and away from said fixed jaw is provided. A thumb wheel having a first end and a second end is also provided. A worm, attached to said thumb wheel, and meshing with said rack is provided. Means for supporting said thumb wheel on said handle is provided wherein said means permits rotation of said thumb wheel with limited axial movement, and wherein rotation of said thumb wheel imparts movement to said moveable jaw. A plurality of engageable recesses is provided on said first end and a plurality of engageable recesses is also provided on said second end of said thumb wheel. A first locking ball bearing and a first locking spring is held within said handle, wherein said first locking spring urges said first locking ball bearing against one of the engageable recesses on said first end of said thumb wheel. A second locking ball bearing and a second locking spring is held within said handle, wherein said second locking spring urges said second locking ball bearing against one of the engageable recesses on said second end of said thumb wheel, wherein rotation of said thumb wheel causes said worm engaging said rack to move said movable jaw relative to said fixed jaw, providing releasably lockable and selectable positions corresponding to common nut dimensions within the adjustable range of said wrench.

DETAILED DESCRIPTION OF THE INVENTION

Figure 1:
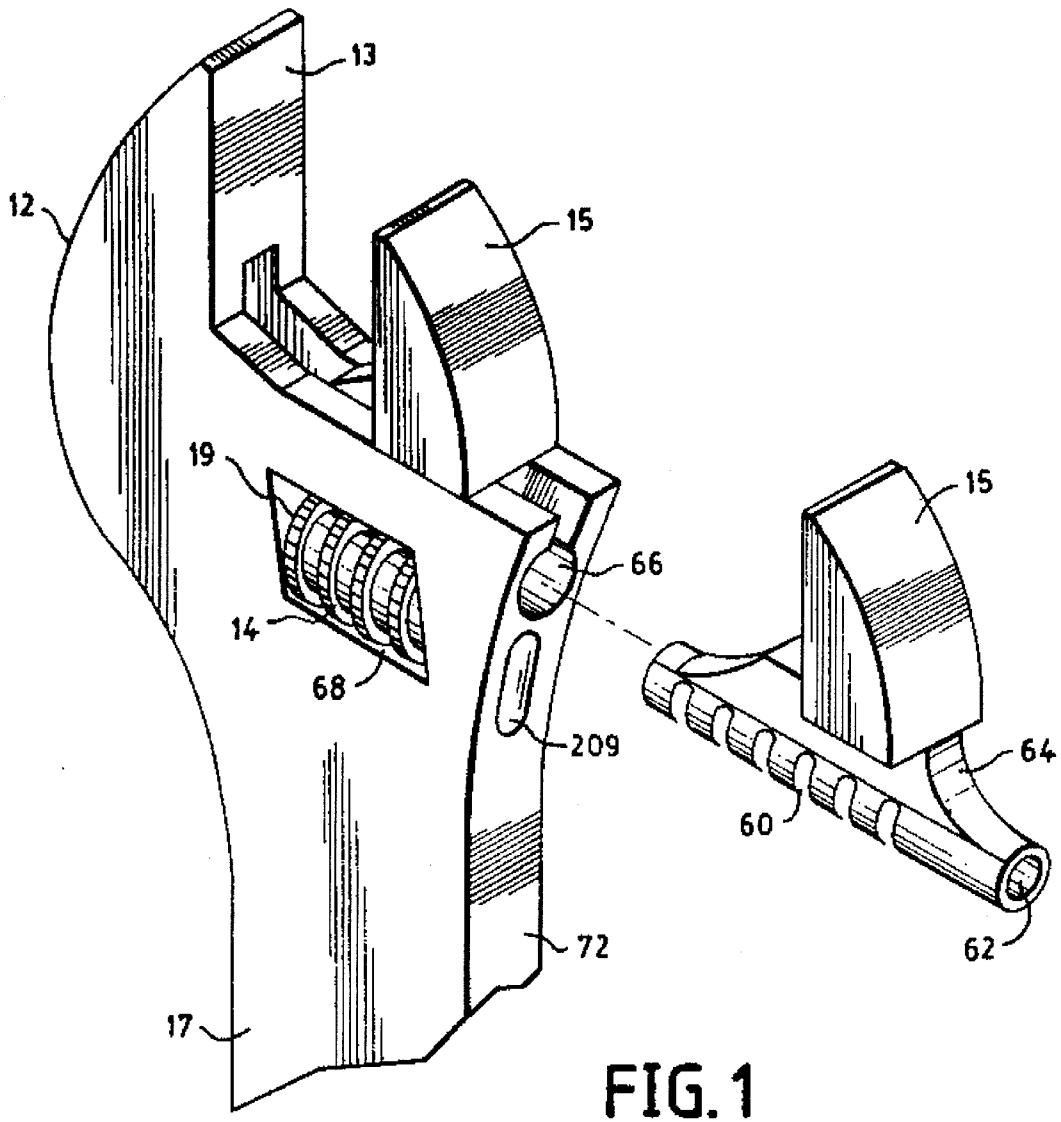
FIG. 1 is an isometric view of the multi-position lockable adjustable wrench in accordance within-he invention.

The invention fully maximizes the ability to lock in a multitude of settings. Three manufacturing options are provided: having the locking mechanism on the fixed jaw side of the wrench; having the locking mechanism on the moveable jaw side of the wrench; and having the locking mechanism on both the fixed jaw side and moveable jaw side of the wrench. FIG. 1 is an isometric view of the multi-position lockable adjustable wrench in accordance with the invention. From outward appearances the invention looks similar to a standard adjustable wrench. That is, moveable jaw 15, also shown removed from the wrench, has tang 64 which has cylinder 62 at its bottom edge. Cylinder 62 is dimensioned to slide within slot 66 located in main body 12. Slot 66 is open on moveable jaw surface 72 and to the opposing surface (not shown) on main body 12. Cylinder 62 is fitted with rack teeth 60. Main body 12 includes fix jaw 13, handle 17 and opening 68.

Thumb wheel 14 is attached with opening 68 in order to have rack teeth 60 of moveable jaw 15 be in alignment with worm 19 on thumb wheel 14. When thumb wheel 14 is rotated, moveable jaw 15 slides either closer or further away from fixed jaw 13, thus permitting the wrench to accommodate a wide range of nut sizes. Although the prior art version of this tool is useful for such applications, frequently moveable jaw 15 will vary from its originally set position and will require the user to readjust it to the desired location. Also, if moveable jaw 15 is not set at the precise location corresponding to the size of the nut to be tightened or removed, a "rounding" of the nut may occur, thus, making it difficult or impossible to remove/tighten. Both of these problems are overcome by the present invention.

It is important to note that a standard moveable jaw 15 including the cylinder 62 and rack teeth are used in invention 10. Also, main body 12 is also substantially the same as a standard wrench except for the need for modifications relating to the unique fastening and locking of the thumb wheel. Also, thumb wheel 14 is similarly sized and has the same worm 19 as the standard counterpart. In this manner, the tooling changes required to produced the invention will be minimal and will enable a manufacturer of prior art adjustable wrenches to manufacture the invention with a minimum of new tool expense.

Figure 2:
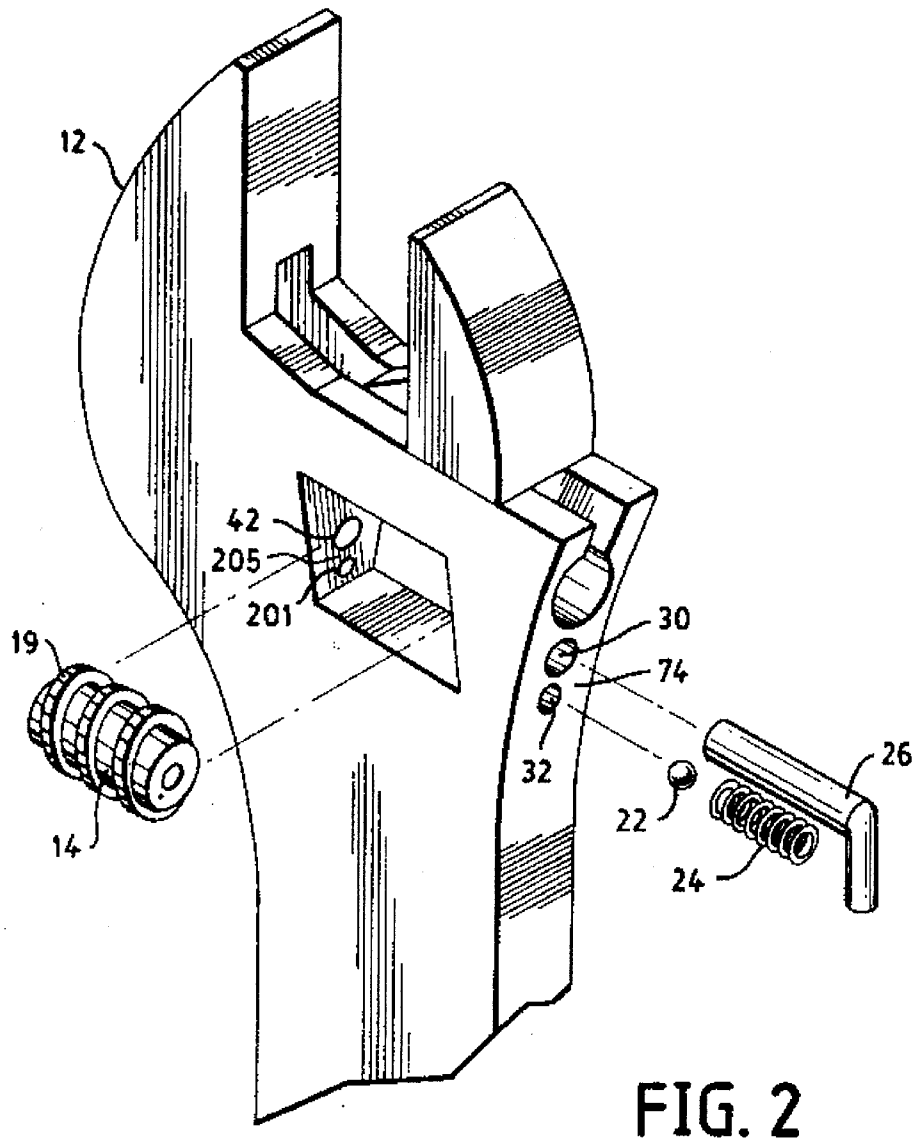
FIG. 2 is an isometric exploded view of the multi-position lockable adjustable wrench.
Figure 3:
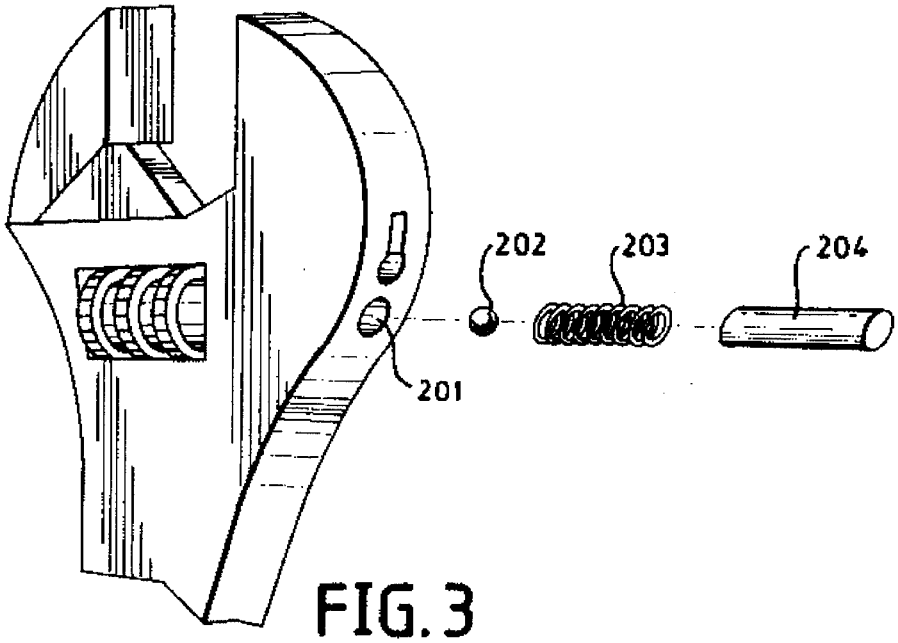
FIG. 3 is an isometric semi-exploded view of the multi-position lockable adjustable wrench.

FIGS. 2 and 3 are isometric exploded views of the multi-position lockable adjustable wrench showing the various parts comprising the invention. Thumb wheel 14 is held within body 12 in a unique manner when compared to a standard adjustable wrench. Thumb wheel 14 does not have a counter sunk hole and spring that pushes thumb wheel 14 to moveable jaw 15 side of the main frame 12. Thumb wheel 14 has a single axle and is attached to main body 12 using retaining pin 26 through retaining pin hole 42 and retaining pin hole 30. Main body frame 12 could be provided with an indentation (not shown) so that retaining pin 26 would be set flush with surface of main body frame 12. Locking mechanism hole 32 is preferable 1/8 inch in diameter. Locking mechanism ball bearing 22 and locking mechanism spring 24 will correspond with locking mechanism hole 32. Locking mechanism spring 24 should have a length that sufficiently locks bearing 22 to thumb wheel 14, yet not so long that locking ball bearing 22 cannot be forced into hole 32 when thumb wheel 14 is rotated. Locking mechanism hole 32 is spaced from pin hole 30 so that metal web 74 is maintained between the respective holes. Locking mechanism hole 201 is preferably 1/8 inch in diameter. Locking mechanism ball bearing 202 and locking mechanism spring 203 will correspond with locking mechanism hole 201. Locking mechanism spring 203 should have a greater tension than locking mechanism 24. The greater tension of spring 203 will urge ball bearing 202 against thumb wheel 14 thus the tension of spring 24 will be overcome by the pushing of thumb wheel 14 against the movable jaw side of main frame 12. Locking mechanism spring 203 should have a length that sufficiently locks bearing 202 and overcomes spring 24 yet not so long that ball bearing 202 cannot be forced into hole 201 when thumb wheel 14 is rotated. Locking mechanism pin 204 has an interference fit with locking mechanism hole 201 with a length that corresponds to the length and tension desired of spring 203. Locking mechanism hole 201 is spaced from pin hole 42 so that metal web 205 is maintained between respective holes. Retaining pin 26 feeds through pin hole 30 through thumb wheel 14 and into pin hole 42. Pin 26 has an interference fit to pin hole 30. The portion of pin 26 that supports thumb wheel 14 is sized so that it will not bind in hole 38 of wheel 14.

Figure 4:
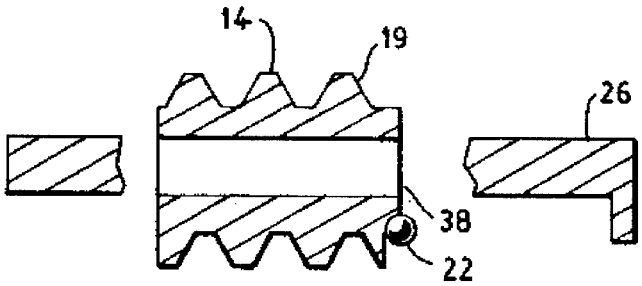
FIG. 4 is a detailed cross-sectional view of the thumb wheel assembly.
Figure 5:
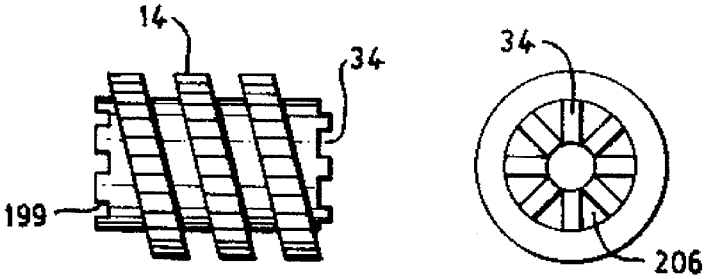
FIG. 5 is a detailed side and end view of the thumb wheel.
Figure 6:
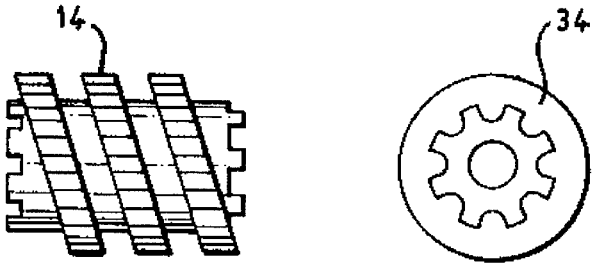
FIG. 6 is a detailed side and end view of an alternative embodiment of the thumb wheel.

The distance between locking mechanism holes 32 and 201 and retaining pin holes 30 and 42 should be as great as possible so that locking ball bearings 22 and 202 engage thumb wheel 14 at its outer edge which is shown in FIGS. 4,5 and 6. At this position, the greatest number of notches can be placed in thumb wheel 14, thus permitting the greatest number of locking positions. Also, metal web 74 and 205 will be s maximum.

The space between thumb wheel 14 and main frame 12 within opening 68 varies from one manufacturer to another. The closer the tolerance is, the better the working action of the locking mechanism. A preferred tolerance of thumb wheel 14 to opening 68 is approximately 0.005 inches.

FIG. 4 is a detailed cross-sectional view of the thumb wheel assembly. Retaining pin hole 38 of thumb wheel 14 is sized in accordance with retaining pin 26. The purpose of retaining pin 26 is to support thumb wheel 14 and to shield and retain the locking ball bearing 22 and its tensioning spring 24 when placed within locking mechanism hole 32.

As noted above, worm 19 must match rack teeth 60 so that when worm 19 engages rack teeth 60, movable jaw 15 will open and close.

FIG. 5 is a detailed side and end view of thumb wheel 14. Recesses 34 and 199 are preferably rectangular notches, approximately 0.040 to 0.050 inches wide with a depth that will not allow locking ball bearings 22 and 202 to bottom out. Taken to the maximum, the width of recesses 34 and 199 could match the diameter of locking ball bearings 22 and 202 with a depth of the recesses being half the diameter of the ball bearings. With this tolerance, locking ball bearings 22 and 202 would be at risk of jamming in recesses 34 and 199.

The spring tension in the width of recesses 34 and 199 will allow bearings 22 and 202 to slide into and out of place to "lock" the wrench in position, yet easily permit repositioning movable jaw 15 at all points between adjacent recesses.

The position of movable jaw 15 relative to fixed jaw 13 is determined by two factors: 1) the number of recesses 34 and 199 on thumb wheel 14 and 2) the pitch of worm 19 and rack teeth 60. For example, if the pitch was selected such that each revolution of wheel 14 caused movable jaw 15 to move ⅛ inches relative to fixed jaw 13 and if the number of recesses were selected to be 8 on a side, then the wrench would have "lockable" positions measured in 128ths.

The timing of the "locking notches" should be set so that when the jaws are completely closed, ball bearing 22 should be centered within the closest recess 34. 0n opposing side of thumb wheel 14 from recesses 34 are recesses 199. Recesses 199 are offset from recesses 34 by 22½ degrees. The number of degrees of offset depends on the number of recesses used. In the above example, 8 recesses are used on each side. If 6 recesses are used on each side, the offset angle would be 30 degrees, and SO on.

The width of recesses 199 are narrower than the width of recesses 34. For example, if recesses 34 were selected to be 0.050 inches wide and recesses 199 were selected to be 0.040 inches wide, this permits a greater tension to be applied to locking mechanism spring 203. By reducing the width of recesses 199 and increasing the tension of locking mechanism spring 203, the following will be accomplished: 1) the force to manually turn thumb wheel 14 from recesses 34 to recesses 199 would remain substantially constant, 2) the greater tension of spring 203 opposed to spring 24 would assure that thumb wheel 14 is forced towards the movable jaw side of main frame 12.

FIG. 6 shows an alternative embodiment of thumb wheel 14. Rather than using notches for recesses 34 and 199, recesses 34 and 199 could utilize the half bowl indentations as shown. The indentations preferably have a width less than or equal to the diameter of the ball bearings. The depth is preferably less than or equal to half the diameter of the ball bearings.

In operation, thumb wheel 14 is "locked" via ball bearing 22 or ball bearing 202 so that wheel 14 cannot change position unless thumb wheel 14 is deliberately rotated 0 by the user. By turning wheel 14, ball bearing 22 is forced back against spring 24 and ball bearing 22 rolls out of its recess 34 coming to rest at a neutral position on surface 206. At the same time ball bearing 202 rolls off surface 206 and "clicks" into its next recess 199 and is retained by spring 203 thereby locking thumb wheel 14.

The floating action of the locking mechanism results in the wrench retaining its set position even if dropped or banged.

To function properly, thumb wheel 14 must always be in contact with main body 12 on the movable jaw side of the wrench. If there is any space between thumb wheel 14 and main body 12 on the movable jaw side, movable jaw 15 will open under a load. Thus, locking mechanism spring 201 must have a greater tension than locking mechanism spring 24.

Figure 7A:
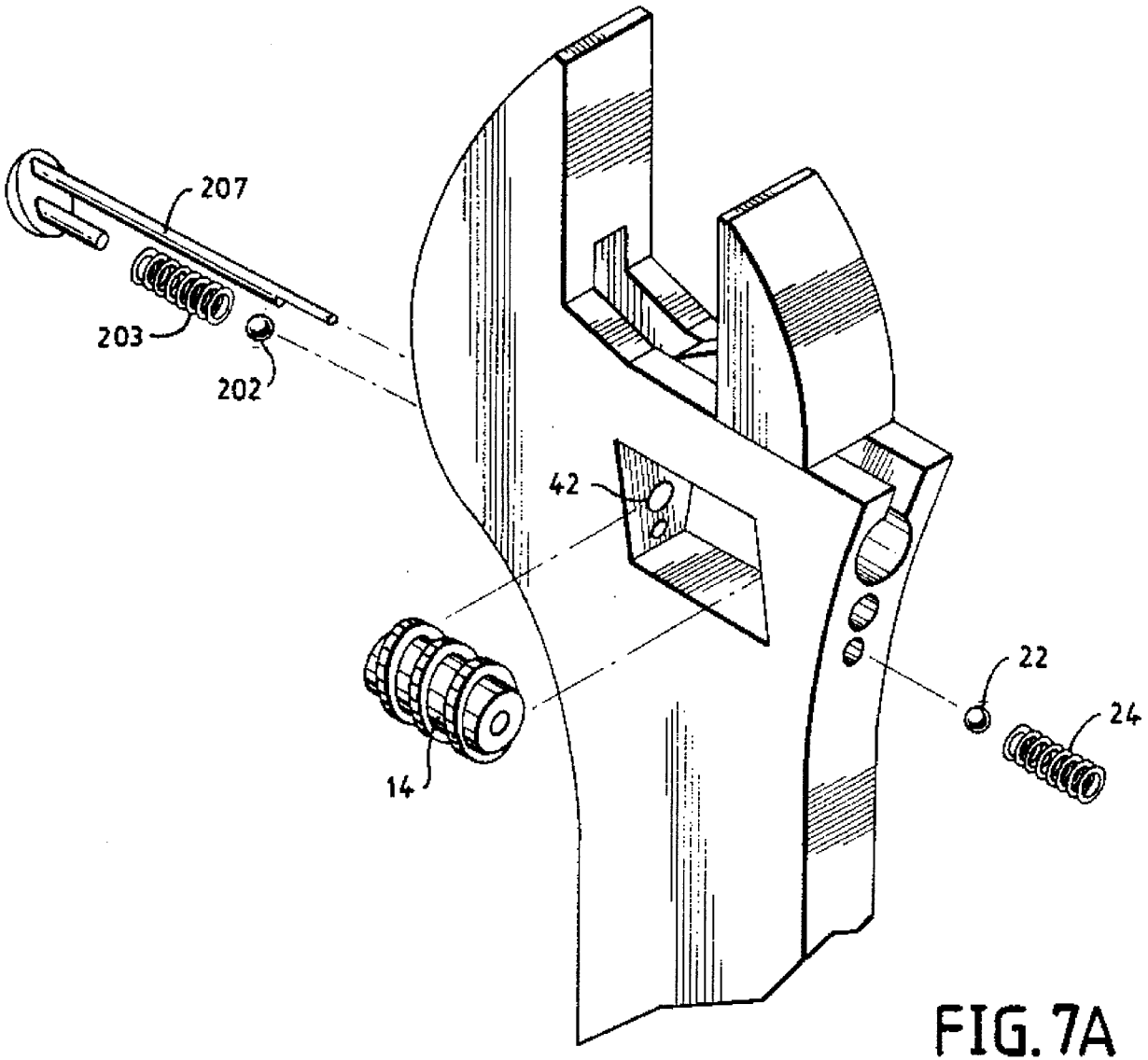
FIG. 7A is an exploded isometric view of an alternative attachment assembly for attaching the thumb wheel to the wrench.
Figure 7B:
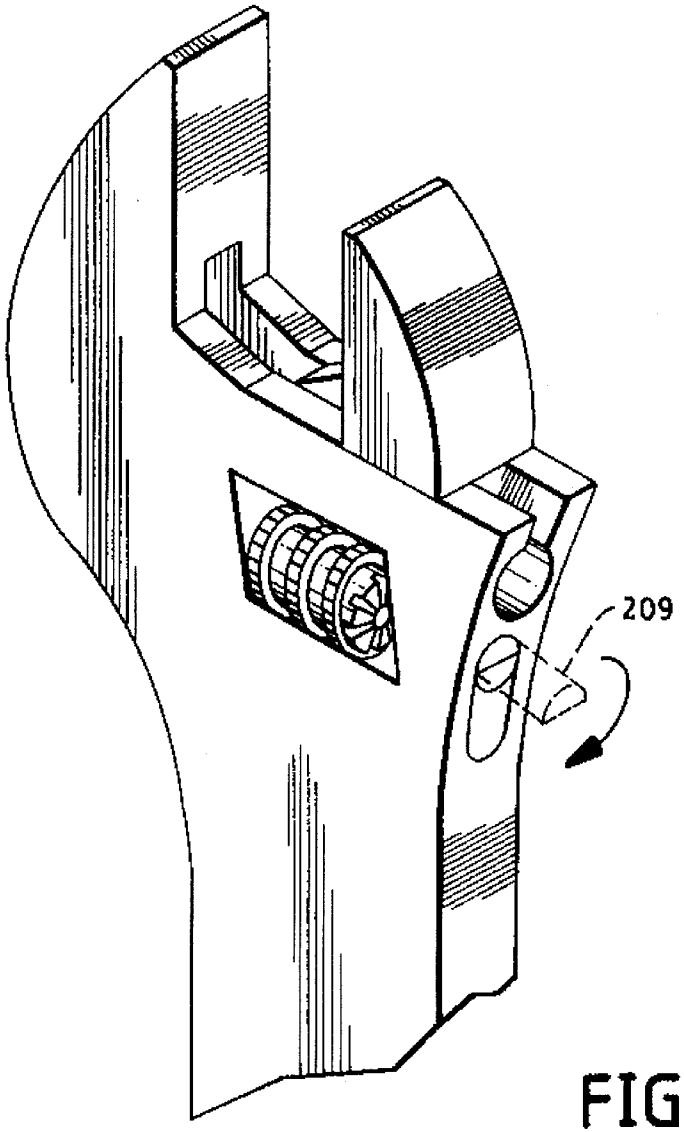
FIG. 7B is an isometric view of the assembled wrench with the tab of the retaining pin still in its open position.
Figure 8:
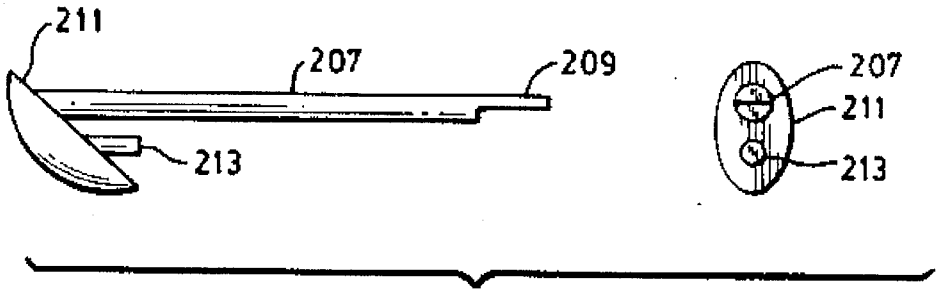
FIG. 8 is a detailed view of the retaining pin.

Referring now to FIGS. 7A, 7B, and 8, an alternative to the use of retaining pin 26 and locking mechanism pin 204 is shown. Retaining pin 207 is dimensioned to slide into position rather than have an interference fit as found with pin 26. As with retaining pin 26, main body frame 12 could be fitted with an indentation so that retaining pin 207 can be made flush with the surface of main body frame 12. Pin 207 retains thumb wheel 14 in opening 68; retains and shields locking mechanism ball bearing 202 and locking mechanism spring 203; and retains and shields locking mechanism ball bearing 22 and locking mechanism spring 24.

Once retaining pin 207 is inserted, it cannot be rotated on its axis. This is achieved by having shorter portion 213 engaging a locking mechanism hole (not shown) on the fixed jaw side of the wrench. Retaining pin 207 cannot move in a horizontal direction. This movement is prevented by shield 211.

The only modification necessary to a standard adjustable wrench to accept pin 207 would be retaining hole 42 which would now have to go all the way through main frame 12.

To assemble, thumb wheel 14 is put into position in opening 68. Locking ball bearing 202 and locking mechanism spring 203 are placed in locking mechanism hole 201. Retaining pin 207 is inserted into hole 42 on the fixed jaw side of the wrench. Retaining pin 207 slides through thumb wheel 14 and on through retaining pin hole 30. At this point, the shorter portion 213 has engaged locking mechanism spring 203 and locking mechanism ball bearing 202. Then, locking mechanism ball bearing 22 and locking mechanism spring 24 can be inserted into locking mechanism hole 32. Tab 209 can now be bent over to engage and shield locking mechanism spring 24 and ball bearing 22.

Figure 9:
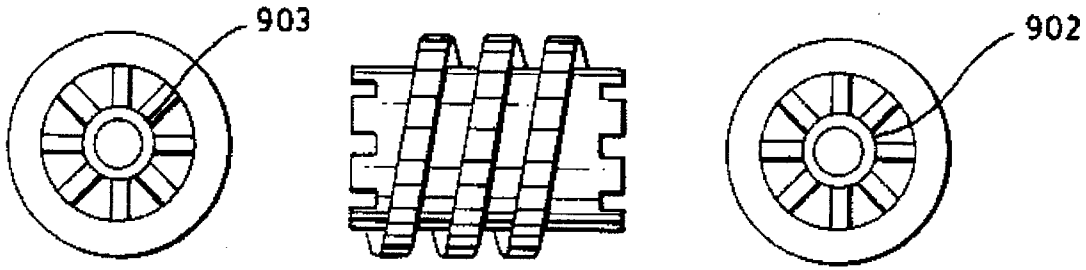
FIG. 9 are side and end views of an alternative embodiment of the thumb wheel.

FIG. 9 are side and end views of an alternative embodiment of thumb wheel 14. In this embodiment, compression sleeve 903 is preferably added only to thumb wheel on the movable jaw side of thumb wheel 14. However, compression sleeve 903 could also be added to both sides. Compression sleeve 903 is made long enough to take out any end play from the thumb wheel to thumb wheel opening in the main frame. The length will be dependent upon thumb wheel 14 tolerances. Compression sleeve 903 protects recesses on movable jaw side of thumb wheel 14 when pressure is applied in the process of tightening and loosening bolts. Compression sleeve 903 can be eliminated if thumb wheel 14 has a length equal to the thumb wheel opening and such that the locking mechanism slots on the movable jaw side of thumb wheel 14 are just long enough to retain the locking ball bearing. In this manner, the locking grooves on the movable jaw side of the thumb wheel could be the same width as the locking grooves on the fixed jaw side of the thumb wheel. Also, the locking spring tension could be the same tension from one side to the other. However, when wear is considered, the width of the thumb wheel grooves and spring tension are important and must be independently considered.

Figure 10:
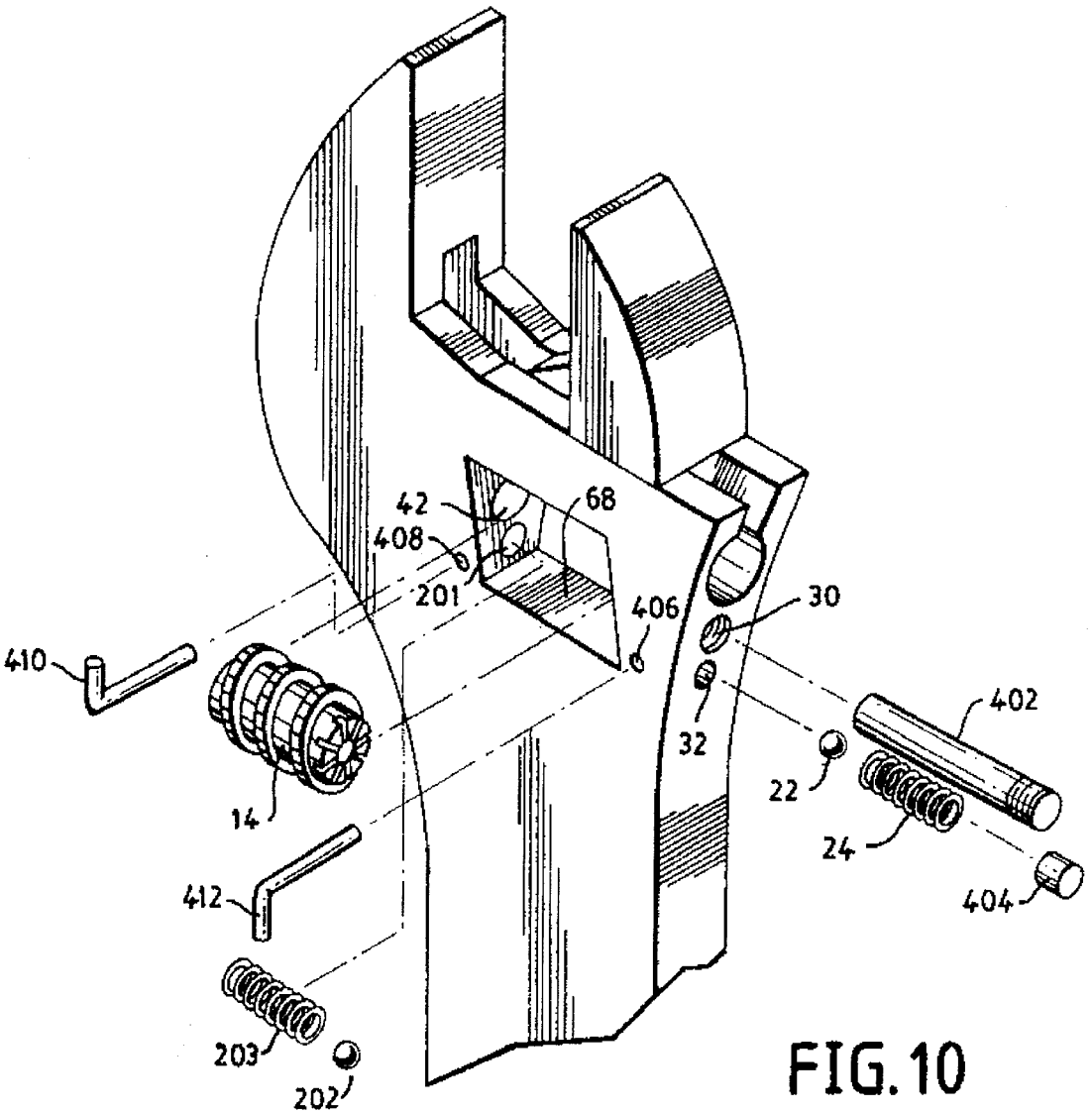
FIG. 10 is an exploded isometric view of another alternative attachment assembly for attaching the thumb wheel to the wrench.

FIG. 10 is an exploded isometric view of another alternative attachment assembly for attaching thumb wheel 14 to the wrench. In this embodiment, hole 30 is drilled through frame 12 to provide blind hole 42. Hole 30 is threaded near the end as shown. Thumb wheel 14 is held within the wrench via pin 402 which is similarly threaded at the movable jaw end. The wrench is assembled by first inserting spring 203 and ball bearing 202 into blind hole 201. Spring 203 and bearing 202 are held in position via pin 410 being fed through hole 408. Next, pin 412 is positioned within hole 406 and bearing 22 and spring 24 are fed into hole 32. Interference pin 404 is then inserted into hole 32, thereby preventing bearing 22 and spring 24 from falling out. Thumb wheel 14 is placed within opening 68 and pin 402 is fed through hole 30, thumb wheel 14 and into hole 42. Pin 402 is screwed tightly to prevent it from backing out. The use of LOCTITE or other methods can also be employed to ensure that pin 402 remains in place. Finally, pins 410 and 412 are removed, and bearings 202 and 22 are free to engage the grooves on thumb wheel 14.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An adjustable jaw wrench with selectable lockable positions comprising:

a handle including a fixed jaw;

a moveable jaw including a rack with a plurality of teeth supported on said handle for movement toward and away from said fixed jaw;

a thumb wheel having a first end and a second end;

a worm, attached to said thumb wheel, and meshing with said rack;

means supporting said thumb wheel on said handle for rotation and limited axial movement, rotation of said thumb wheel imparting movement to said moveable jaw;

a plurality of engageable recesses on said first end and a plurality of engageable recesses on said second end of said thumb wheel; wherein said first end recesses have a width that is greater than the width of said second end recesses;

a first locking ball bearing and a first locking spring in said handle; wherein said first locking spring urges said first locking ball bearing against one of the engageable recesses on said first end of said thumb wheel, and a second locking ball bearing and a second locking spring in said handle; wherein said second locking spring urges said second locking ball bearing against one of the engageable recesses on said second end of said thumb wheel, wherein rotation of said thumb wheel causes said worm engaging said rack to move said movable jaw relative to said fixed jaw, providing releasably lockable and selectable positions corresponding to common nut dimensions within the adjustable limits of said wrench.

2. The adjustable jaw wrench with selectable lockable positions of claim 1 wherein said thumb wheel having a turning axis, and wherein said recesses extend radially with respect to the turning axis of said thumb wheel and being of generally rectangular cross-sectional shape.

3. The adjustable jaw wrench with selectable lockable position of claim 1 wherein said thumb wheel having an outer perimeter, and wherein said recesses extend circumferentially around the outer perimeter of said thumb wheel, said recesses being of generally half bowl indentations having a diameter corresponding to the diameter of the said locking ball bearing.

4. The adjustable jaw wrench with selectable lockable positions of claim 1 wherein said first end recesses are on the end of said thumb wheel that is adjacent to said movable jaw.

5. The adjustable jaw wrench with selectable lockable positions of claim 4 wherein the tension of said second locking spring is greater than the tension of said first locking spring.

6. An adjustable jaw wrench with selectable lockable positions comprising:

a handle including a fixed jaw;

a moveable law including a rack with a plurality of teeth supported on said handle for movement toward and away from said fixed jaw;

a thumb wheel having a first end and a second end;

a worm, attached to said thumb wheel, and meshing with said rack;

means supporting said thumb wheel on said handle for rotation and limited axial movement, rotation of said thumb wheel imparting movement to said jaw;

a plurality of engageable recesses on said first end and a plurality of engageable recesses on said second end of said thumb wheel; wherein said first end recesses are offset from said second end recesses by a number of degrees which corresponds to the number of recesses;

a first locking ball bearing and a first locking spring in said handle; wherein said first locking spring urges said first locking ball bearing against one of the engageable recesses on said first end of said thumb wheel, and a second locking ball bearing and a second locking spring in said handle; wherein said second locking spring urges said second locking ball bearing against one of the engageable recesses on said second end of said thumb wheel, wherein rotation of said thumb wheel causes said worm engaging said rack to move said moveable jaw relative to said fixed jaw, providing releasably lockable and selectable positions corresponding to common nut dimensions within the adjustable limits of said wrench.

7. The adjustable jaw wrench with selectable lockable positions of claim 6 wherein said means supporting said thumb wheel on said handle further comprises a retaining assembly having a first pin with a tab and a substantially parallel shorter second pin wherein said first pin is fitted through said thumb wheel and said second pin holds second spring and said second ball bearing in place against the recesses of said second end of said thumb wheel, such that when said tab is folded against said wrench, said thumb wheel is locked into place within said wrench.

8. The adjustable jaw wrench with selectable lockable positions of claim 6 wherein said means supporting said thumb wheel on said handle further comprises a partially threaded pin to hold said thumb wheel within said handle and wherein said first and second springs and corresponding first and second ball bearings are held within said wrench via respectively first and second removable pins such that once said thumb wheel is positioned within said wrench, said first and second removable pins can be withdrawn, thereby releasing said first and second ball bearings to engage the respective recesses of said first and second ends of said thumb wheel.

9. An adjustable jaw wrench with selectable lockable positions comprising:

a handle including a fixed jaw;

a moveable jaw including a rack with a plurality of teeth supported on said handle for movement toward and away from said fixed jaw;

a thumb wheel having a first end, a second end, and a turning axis; wherein said thumb wheel further comprises a compression sleeve centered about the turning axis of said thumb wheel extending from one of said ends of said thumb wheel;

a worm, attached to said thumb wheel, and meshing with said rack;

means supporting said thumb wheel on said handle for rotation, rotation of said thumb wheel imparting movement to said moveable jaw;

a plurality of engageable recesses on said first end and a plurality of engageable recesses on said second end of said thumb wheel;

a first locking ball bearing and a first locking spring in said handle; wherein said first locking spring urges said first locking ball bearing against one of the engageable recesses on said first end of said thumb wheel, and a second locking ball bearing and a second locking spring in said handle; wherein said second locking spring urges said second locking ball bearing against one of the engageable recesses on said second end of said thumb wheel, wherein rotation of said thumb wheel causes said worm engaging said rack to move said movable jaw relative to said fixed jaw, providing releasably lockable and selectable positions corresponding to common nut dimensions within the adjustable limits of said wrench.

10. The adjustable jaw wrench with selectable lockable positions of claim 9 wherein said compression sleeve centered about the turning axis of said thumb wheel extends from said first end.

11. The adjustable jaw wrench with selectable lockable positions of claim 9 wherein said compression sleeve centered about the turning axis of said thumb wheel extends from said second end.

12. The adjustable jaw wrench with selectable lockable positions of claim 9 wherein a first compression sleeve extends from said first end and a second compression sleeve extends from said second end wherein said first and second compression sleeves are substantially identical with respect to diameter.

* * * * *